US011375600B2

(12) United States Patent
Tanaka et al.

(10) Patent No.: US 11,375,600 B2
(45) Date of Patent: Jun. 28, 2022

(54) CONTROL DEVICE, CONTROL METHOD, AND RECORDING MEDIUM

(71) Applicant: NAGOYA ELECTRIC WORKS CO., LTD., Aichi (JP)

(72) Inventors: Atsushi Tanaka, Toyoake (JP); Hiroaki Sengoku, Ichinomiya (JP); Koji Miyagawa, Ama (JP)

(73) Assignee: NAGOYA ELECTRIC WORKS CO., LTD., Aichi (JP)

( * ) Notice: Subject to any disclaimer, the term of this patent is extended or adjusted under 35 U.S.C. 154(b) by 0 days.

(21) Appl. No.: 17/454,890

(22) Filed: Nov. 15, 2021

(65) Prior Publication Data

US 2022/0159815 A1 May 19, 2022

(30) Foreign Application Priority Data

Nov. 18, 2020 (JP) ..... JP2020-191657

(51) Int. Cl.
*H05B 47/19* (2020.01)

(52) U.S. Cl.
CPC ..... *H05B 47/19* (2020.01)

(58) Field of Classification Search
None
See application file for complete search history.

(56) References Cited

U.S. PATENT DOCUMENTS

2005/0285508 A1* 12/2005 Murayama ..... H01L 51/5265 313/503
2006/0001033 A1* 1/2006 Tsujimura ..... H01L 27/3244 313/506
2008/0239185 A1* 10/2008 Takahashi ..... H01L 27/1214 349/43

FOREIGN PATENT DOCUMENTS

JP H10-153975 A 6/1998
JP 6372917 B2 8/2018

* cited by examiner

*Primary Examiner* — Monica C King
(74) *Attorney, Agent, or Firm* — Osha Bergman Watanabe & Burton LLP

(57) ABSTRACT

A control device controls a plurality of light emitting devices, and includes: a controller that: collects device information from the light emitting devices that are repeatedly turned on and off in a lighting pattern, wherein a turn-on period and a turn-off period are defined within a cycle in the lighting pattern; determines an arrangement order of the light emitting devices based on the device information; calculates a start time at which each of the light emitting devices starts repetition of the lighting pattern using the arrangement order; and transmits lighting information including the start time to each of the light emitting devices and causes each of the light emitting devices to start the repetition of the lighting pattern.

6 Claims, 11 Drawing Sheets

CONTROL DEVICE, CONTROL METHOD, AND RECORDING MEDIUM

BACKGROUND

(1) Technical Field

The present invention relates to a control device, a control method, and a computer readable recording medium storing instructions.

(2) Description of Related Art

Conventionally, there is known a technique in which a plurality of light emitting devices are arranged along a road, and the light emitting devices are turned on and off in an arrangement order to provide visual recognition as if a lighting position of a light emitting device is moving along the road. For example, JP H10-153975 A discloses a delineator system that sets timings of turning on and off each light emitting device based on a pulse signal synchronized with a universal time coordinated.

SUMMARY

In the delineator system disclosed in JP H10-153975 A, in order to provide visual recognition as if a lighting position of a light emitting device is moving along the road, it is necessary to set the timings of turning on and off each light emitting device to be shifted in an arrangement order of the light emitting devices. Therefore, a setting operation for accurately turning on the light emitting devices in a lighting pattern according to the arrangement order is very complicated.

One or more embodiments of the present invention provide a technique capable of easily turning on light emitting devices in a lighting pattern according to an arrangement order of the light emitting devices.

In one or more embodiments, a control device comprises a first controller that functions as: an information collection unit that collects device information from a plurality of light emitting devices which are repeatedly turned on and off in a lighting pattern in which a turn-on period and a turn-off period within one cycle are defined; an arrangement order determination unit that determines an arrangement order of the light emitting devices based on the device information; a time calculation unit that calculates a start time at which each of the light emitting devices starts repetition of the lighting pattern using the arrangement order; and a lighting control unit that transmits lighting information including the start time to each of the light emitting devices and causes each of the light emitting devices to start the repetition of the lighting pattern.

Furthermore, in one or more embodiments, a control method for controlling a plurality of light emitting devices which are repeatedly turned on and off in a lighting pattern in which a turn-on period and a turn-off period are defined, including:

an information collection step of collecting device information from the light emitting devices;

an arrangement order determination step of determining an arrangement order of the light emitting devices based on the device information;

a time calculation step of calculating a start time at which each of the light emitting devices starts repetition of the lighting pattern using the arrangement order; and a lighting control step of transmitting lighting information including the start time to each of the light emitting devices and causing each of the light emitting devices to start the repetition of the lighting pattern.

Furthermore, in one or more embodiments, a non-transitory computer readable recording medium storing instructions that cause a computer to function as:

an information collection unit that collects device information from a plurality of light emitting devices which are repeatedly turned on and off in a lighting pattern in which a turn-on period and a turn-off period within one cycle are defined;

an arrangement order determination unit that determines an arrangement order of the light emitting devices based on the device information;

a time calculation unit that calculates a start time at which each of the light emitting devices starts repetition of the lighting pattern using the arrangement order; and a lighting control unit that transmits lighting information including the start time to each of the light emitting devices and causes each of the light emitting devices to start the repetition of the lighting pattern.

In the configurations of the control device, the control method, and the computer readable recording medium described above, the arrangement order of the light emitting devices is determined on the basis of the device information. Therefore, the light emitting devices can be easily turned on in a lighting pattern according to the arrangement order of the light emitting devices.

DETAILED DESCRIPTION OF EMBODIMENTS

Embodiments of the present invention will be described in the following order.

(1) Configuration of control device:

(2) Lighting setting process:

(3) Lighting execution process:

(4) Other embodiments:

(1) Configuration of Control Device

Figure 1:
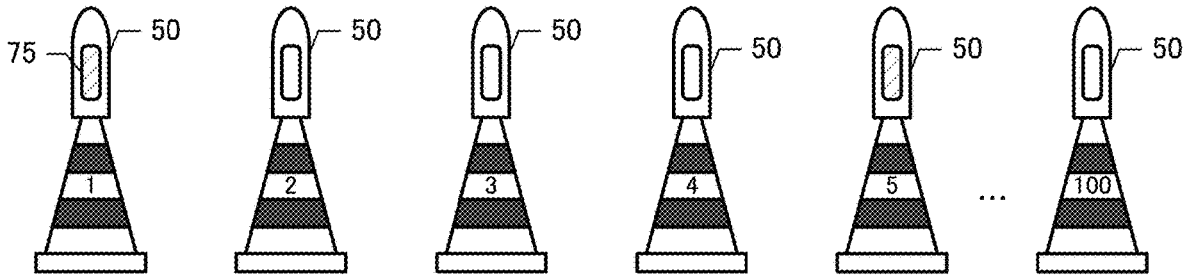
FIG. 1 is an explanatory diagram showing an appearance of light emitting devices.

FIG. 1 is an explanatory diagram showing an appearance of a plurality of light emitting devices 50 of which lighting is controlled by a control device 10 (illustrated in FIG. 2) according to one or more embodiments of the present invention. The light emitting devices 50 are each provided at a top of a conical cone. The light emitting devices 50 each include a lighting unit 75. The lighting unit 75 is a light emitter, and is an LED that emits green light in one or more embodiments. Numbers displayed on surfaces of the cones indicate numbers of the light emitting devices 50. In one or more embodiments, the plurality of light emitting devices 50 are arranged along a road in an order of the numbers displayed on the cones (for example, in an order of numbers 1 to 100), and the lighting units 75 of the light emitting devices 50 are turned on or off according to the arrangement order. A passenger of a vehicle traveling on a road visually recognizes turning on and off by the plurality of light emitting devices 50 as if a lighting position is moving along the road. In FIG. 1, the lighting units 75 of the first and fifth light emitting devices 50 from the left side of the figure are turned on, and the lighting units 75 of the second to fourth and $100^{th}$ light emitting devices 50 are turned off.

Figure 2:
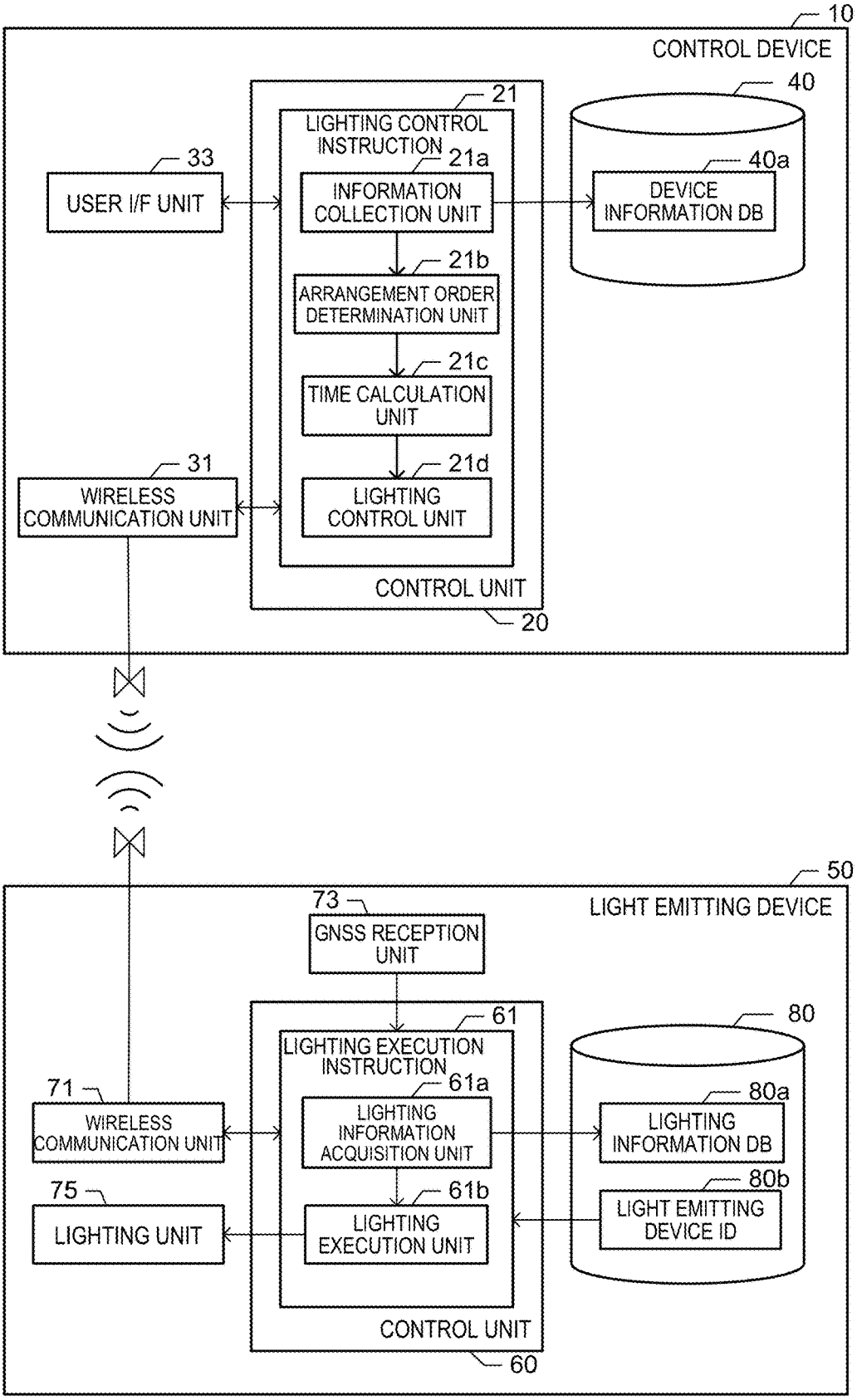
FIG. 2 is a block diagram of a control device and a light emitting device.

FIG. 2 is a block diagram showing a configuration of the control device 10 according to one or more embodiments of the present invention. FIG. 2 also includes a block diagram showing a configuration of the light emitting device 50 in addition to the control device 10. The control device 10 is a terminal that can be carried by an operator. The control device 10 includes a control unit (i.e., the first controller or a first computer) 20 including a CPU, a RAM, a ROM, and the like, a wireless communication unit 31, a user I/F unit 33, and a recording medium 40. By executing a lighting control instruction 21, the control unit 20 can transmit a start time and a lighting pattern which will be described later to each of the light emitting devices 50 arranged along the road, and can also instruct end of lighting in the lighting pattern. Details of the lighting control instruction 21 will be described later. The wireless communication unit 31 is a wireless communication circuit for the control device 10 to communicate with the light emitting devices 50. The control device 10 and the light emitting devices 50 communicate with each other using a wireless channel. The user I/F unit 33 is an interface unit for receiving an input from an operator and providing various types of information to the operator, and includes a display unit including a touch panel display (not illustrated), an input unit composed of a touch panel, various buttons, and the like, and a sound output unit such as a speaker. In the recording medium 40, device information DB 40*a* is recorded. The device information DB 40*a* includes device information collected from the plurality of light emitting devices 50 by a function of an information collection unit 21*a* which will be described later. In addition, the control device 10 includes a clocking circuit (not illustrated)

On the other hand, the light emitting devices 50 each include a control unit (i.e., a second controller or a second computer) 60 including a CPU, a RAM, a ROM, and the like, a wireless communication unit 71, a GNSS reception unit 73, a lighting unit 75, and a recording medium 80. By executing a lighting execution instruction 61, the control unit 60 can cause the lighting unit 75 to execute turning on and off of the light emitting device 50 by using a start time and a lighting pattern which will be described later. Details of the lighting execution instruction 61 will be described later. The wireless communication unit 71 is a wireless communication circuit for communicating with the wireless communication unit 31 of the control device 10. The GNSS reception unit 73 is a device that receives a signal of a Global Navigation Satellite System. The GNSS reception unit 73 receives a radio wave from a navigation satellite, and outputs a signal for calculating a position of each of the light emitting devices 50 via an interface (not illustrated). The control unit 60 acquires this signal and specifies the position of the light emitting device 50. As described with reference to FIG. 1, the lighting unit 75 is a light emitter. In the recording medium 80, lighting information DB 80*a* and a light emitting device ID 80*b* are recorded. The lighting information DB 80*a* includes information indicating a lighting pattern in which a turn-on period and a turn-off period within one cycle are defined and a start time at which repetition of the lighting pattern is started. The information indicating the lighting pattern and the start time included in the lighting information DB 80*a* is updated each time the information is received from the control device 10. The light emitting device ID 80*b* is information for identifying the light emitting device 50. In addition, the light emitting device 50 includes a clocking circuit (not illustrated).

Figure 3:
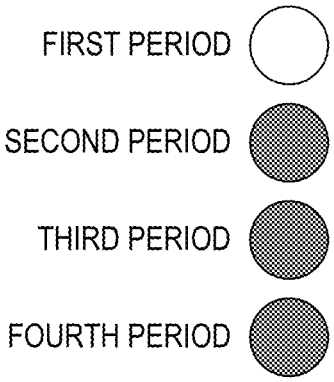
FIG. 3 is an explanatory diagram for explaining details of a lighting pattern.

FIG. 3 is an explanatory diagram for explaining details of a lighting pattern. FIG. 3 illustrates a lighting pattern used in the description of one or more embodiments. The lighting pattern illustrated in FIG. 3 indicates a transition of a turn-on state in the lighting unit 75 of one light emitting device 50 over one cycle. In FIG. 3, the transition of the turn-on state is illustrated by changing circles indicating the turn-on state from an upper side to a lower side of the figure. That is, the lighting pattern according to one or more embodiments indicates that a cycle of turn-on, turn-off, turn-off, and turn-off is repeated after one round of turn-on, turn-off, turn-off, and turn-off. A white circle indicates a turn-on period, and a black circle indicates a turn-off period. The lighting pattern illustrated in FIG. 3 includes four periods (a first period to a fourth period) obtained by equally dividing one cycle. In one or more embodiments, one period has a length of 0.3 seconds, and thus a length of the entire lighting pattern illustrated in FIG. 3 is 1.2 seconds. The light emitting device 50 turns on or off depending on whether each period (in FIG. 3, four periods of the first period to the fourth period) included in the lighting pattern is a turn-on period or a turn-off period. That is, when the light emitting device 50 is turned on and off in the lighting pattern illustrated in FIG. 3, a pattern is repeated in which the turn-on state is continued for 0.3 seconds after start of the lighting pattern, and then a turn-off state is continued for 0.9 seconds. As described above, the lighting pattern is defined by three parameters: a total number of periods (the turn-on periods and the turn-off periods) included in the lighting pattern, a length per period (the turn-on period and the turn-off period), and which one of the turn-on period and the turn-off period each period is. In one or more embodiments, in the control device 10, the three parameters defining the lighting pattern can be arbitrarily set by an operator's input via the user I/F unit 33 (details of setting will be described on an operation screen OP in FIG. 4A).

Returning to the description of FIG. 2, the lighting control instruction 21 executed by the control unit 20 of the control device 10 will be described. By executing the lighting control instruction 21, the control unit 20 can set the lighting pattern and the start time for each of the light emitting devices 50 arranged along the road, and can instruct end of lighting in the lighting pattern. The lighting control instruction 21 includes an information collection unit 21*a*, an arrangement order determination unit 21*b*, a time calculation unit 21*c*, and a lighting control unit 21*d*. The control unit 20 collects device information from the plurality of light emitting devices 50 by functioning as the information collection unit 21*a*. In one or more embodiments, the device information includes position information (latitude and longitude) of the light emitting device 50 and a light emitting device ID. Specifically, by the function of the information collection unit 21*a*, the control unit 20 broadcast-transmits a transmission request for device information and information indicating a control device ID which is information for identifying the control device 10, from the control device 10 to the plurality of light emitting devices 50 via the wireless communication unit 31. At this time, the information also includes one unused channel detected from among a plurality of wireless channels that can be used by the control device 10. Each of the light emitting devices 50 that have received the information transmits the device information to the control device 10 specified by the control device ID using the unused channel. Then, the control unit 20 collects the device information including the position information from the plurality of light emitting devices 50. The position information of each of the light emitting devices 50 and the light emitting device ID included in the collected device information are recorded in the device information DB 40*a*. The light emitting device ID is recorded in association with an unused channel for use in communication with the light emitting device 50 indicated in the light emitting device ID.

The control unit 20 determines the arrangement order of the light emitting devices 50 on the basis of the device information by functioning as the arrangement order determination unit 21*b*. In one or more embodiments, a correspondence table in which the numbers of the light emitting devices 50 (the numbers displayed on the surfaces of the cones in FIG. 1) and the light emitting device IDs are associated with each other is recorded in the ROM of the control device 10. The control unit 20 determines the arrangement order of the light emitting devices 50, referring to the collected light emitting device IDs and the correspondence table. The determined arrangement order is recorded in the RAM of the control device 10.

By functioning as the time calculation unit 21*c*, the control unit 20 calculates the start time at which each of the light emitting devices 50 starts repetition of the lighting pattern using the determined arrangement order. Specifically, the control unit 20 determines the start time of the first light emitting device 50 in the arrangement order (details will be described with reference to FIG. 4A) according to the operator's input via the user I/F unit 33, and then calculates the start times of the second and subsequent light emitting devices 50 in the arrangement order by adding T to the start time of the light emitting device 50 arranged one before from the light emitting device 50. Here, T is a length per period among four periods obtained by equally dividing one cycle of the lighting pattern. In one or more embodiments, the length (=T) per period is 0.3 seconds, and thus the start time of the second light emitting device 50 in the arrangement order is a time obtained by adding 0.3 seconds to the start time of the first light emitting device 50 in the arrangement order. Similarly, for example, the start time of the $50^{th}$ light emitting device 50 in the arrangement order is a time obtained by adding 0.3 seconds to the start time of the $49^{th}$ light emitting device 50 in the arrangement order.

By functioning as the lighting control unit 21*d*, the control unit 20 transmits the lighting information including the start time to each of the light emitting devices 50, and causes each of the light emitting devices 50 to start repetition of the lighting pattern. Specifically, the control unit 20 refers to the light emitting device ID recorded in the device information DB 40*a*, and transmits the lighting information including the start time calculated for each of the light emitting devices 50 to each of the light emitting devices 50 via the wireless communication unit 31. At this time, the wireless channel recorded in association with the light emitting device ID is used for communication. The lighting information is information used by the light emitting device 50 to execute turn-on and turn-off according to the lighting pattern. In one or more embodiments, the lighting pattern arbitrarily set in the control device 10 is also included in the lighting information together with the start time, and the lighting information is transmitted to each of the light emitting devices 50. Each of the light emitting devices 50 that have received the lighting information including the start time and the lighting pattern updates the start time and the lighting pattern in lighting information DB 80*a*. After the start time elapses and the light emitting device 50 starts turning on and off in accordance with the lighting pattern, the control unit 20, when receiving an end instruction from the operator via the user I/F unit 33, can also transmit an end signal instructing to end turning on and off in accordance with the lighting pattern to each of the light emitting devices 50.

Next, the lighting execution instruction 61 executed by the control unit 60 of the light emitting device 50 will be described. By executing the lighting execution instruction 61, the control unit 60 can cause the lighting unit 75 to execute turning on and off of the light emitting device 50 by using the start time and the lighting pattern. The lighting execution instruction 61 includes a lighting information acquisition unit 61*a* and a lighting execution unit 61*b*. The control unit 60 acquires the lighting information including the start time and the lighting pattern transmitted from the control device 10 via the wireless communication unit 71 by the function of the lighting information acquisition unit 61*a*. The acquired lighting information is recorded in the lighting information DB 80*a*. When a current time reaches the start time, the control unit 60 starts execution of the lighting pattern by the lighting unit 75, by the function of the lighting execution unit 61*b*. In one or more embodiments, the control unit 60 starts execution of the lighting pattern by the lighting unit 75 from the first period of the lighting pattern. Specifically, when the lighting pattern illustrated in FIG. 3 is executed by the lighting unit 75, the lighting pattern is executed from the turn-on period that is the first period of the lighting pattern. In addition, when the light emitting device 50 receives an end signal instructing to end the lighting pattern from the control device 10, the control unit 60 ends turning on and off of the lighting unit 75 according to the lighting pattern by the function of the lighting execution unit 61*b*.

Figure 4A:
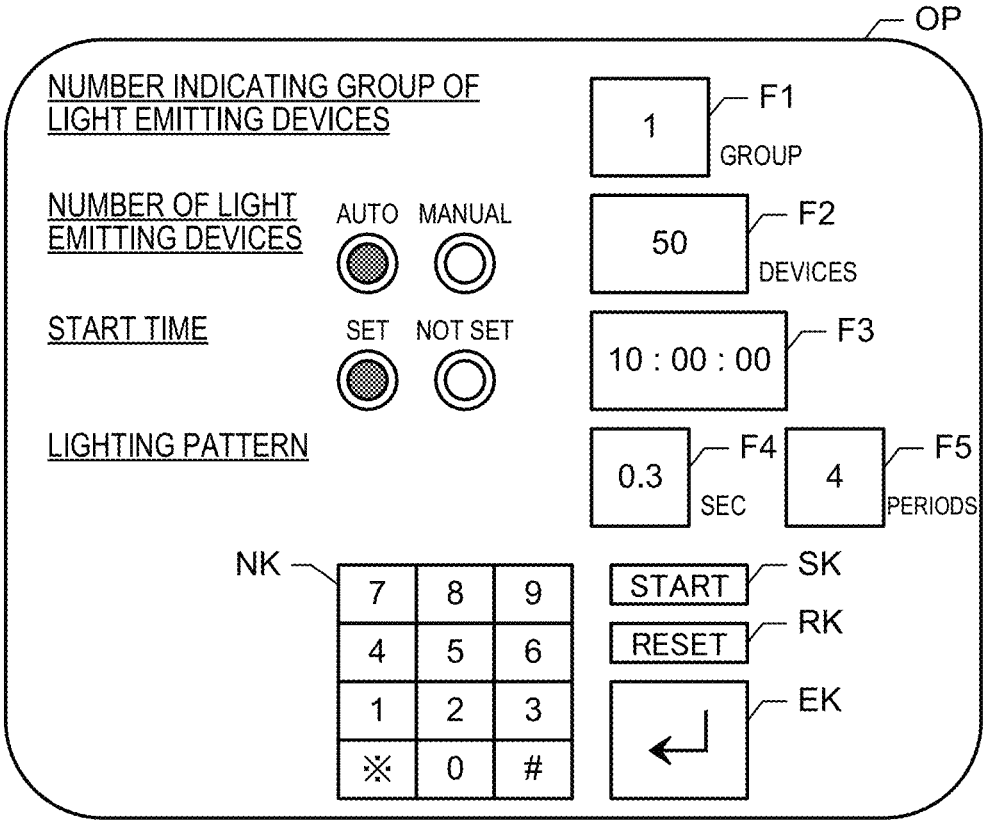
FIG. 4A is a diagram showing an example of an operation screen.

FIG. 4A is a diagram showing an example of an operation screen OP displayed on the user I/F unit 33 when the lighting control instruction 21 is executed in the control device 10. When the operator operates the control device 10 to display the operation screen OP on the user I/F unit 33 and then touches a start key SK, an input in a numeric keypad NK will be reflected in a frame F1. A numerical value input into the frame F1 indicates a "number indicating a group of light emitting devices". In one or more embodiments, an upper limit of the number of light emitting devices 50 that can communicate with the control unit 20 at a time while the control unit 20 of the control device 10 executes the lighting control instruction 21 is 50. Therefore, for example, when setting the start time and the lighting pattern for the 100 light emitting devices 50 arranged along the road, it is necessary to divide the 100 light emitting devices 50 into two or more groups and to perform the setting by the number of groups. The operation screen OP is a screen for setting the start time and the lighting pattern for one group among a plurality of groups when the plurality of light emitting devices 50 arranged along the road are divided into the plurality of groups. When a touch operation is performed on the start key SK, first, various settings for the first group can be performed using the operation screen OP. Specifically, when a touch operation is performed on the start key SK, first, only an input of 1 as a numerical value indicating the first group is permitted in the frame F1. That is, a numeric character different from 1, when input from the numeric keypad NK, is not reflected in the frame F1. The numerical value is a "number indicating group of light emitting devices". The "number indicating group of light emitting devices" is a group number of the light emitting device 50 as a target when the control device 10 sets the start time and the lighting pattern. A reset key RK is a key that, when a touch operation is performed, enables re-input of a frame immediately before a frame that is a current input target among frames F2 to F5.

After 1 is input as the numerical value indicating the first group into the frame F1, it is possible to perform a touch operation on portions displayed as "auto" and "manual" in the operation screen OP. In a case where a touch operation is performed on the "auto", broadcast transmission (information to be transmitted includes one unused channel) from the control device 10 to the plurality of light emitting devices 50 is executed by the function of the information collection unit 21*a* described above. Then, the number of light emitting devices 50 determined to be targets included in one group is automatically input into a frame F2 in the control device 10. The number in the frame F2 indicates a "number of light emitting devices" included in the group (the first group in FIG. 4A) indicated by the "number indicating group of light emitting devices". In FIG. 4A, since the number of light emitting devices 50 included in the group is determined to be 50, 50 is input as a numerical value into the frame F2. Note that the control unit 20 determines the number of target light emitting devices 50 included in one group on the basis of selection conditions 1 and 2 which will be described below. Specifically, the numbers of the light emitting devices 50 that have transmitted the device information are calculated with reference to the light emitting device ID included in each collected device information and the correspondence table in which the numbers of the light emitting devices 50 and the light emitting device IDs are associated with each other, and the number of light emitting devices 50 having consecutive numbers from the smallest number among the numbers is selected (selection condition 1). When the number of light emitting devices 50 having consecutive numbers is larger than the upper limit (the upper limit of the number of light emitting devices 50 that can communicate with the control unit 20 at a time), i.e., 50, the 50 light emitting devices 50 having consecutive numbers in the ascending order from the smallest number are determined to be targets included in one group (selection condition 2). For example, in a case where the calculated numbers are numbers 1 to 26 and number 28 to 50, the light emitting devices 50 of numbers 1 to 26 are selected as the target light emitting devices 50 included in one group. In addition, in a case where the selected numbers are numbers 1 to 58, the light emitting devices 50 of numbers 1 to 50 are determined as the target light emitting devices 50 included in one group. On the other hand, when a touch operation is performed on the "manual", an input in the numeric keypad NK will be reflected in the frame F2. Then, when a determination key EK is input after an arbitrary numeric character of 50 or less is input into the frame F2, broadcast transmission from the control device 10 to the plurality of light emitting devices 50 is executed by the function of the information collection unit 21*a* described above. As in the case of the "auto", the number of target light emitting devices 50 included in one group is determined on the basis of the selection conditions 1 and 2. In the case of the "manual", the numeric character input in the frame F2 is set as the upper limit number of light emitting devices used for the selection condition 2. When the number of light emitting devices 50 included in the group determined based on the selection conditions 1 and 2 is smaller than the numeric character input in the frame F2, the numeric character input in the frame F2 is automatically corrected to a numeric character indicating the number of light emitting devices. In this way, when the "number of light emitting devices" is set, the arrangement order of the light emitting devices 50 corresponding to the "number of light emitting devices" included in the group (the first group in FIG. 4A) indicated by the "number indicating group of light emitting devices" is determined by the function of the arrangement order determination unit 21*b* described above.

After the numerical value indicating the "number of light emitting devices" is set in the frame F2 by the "auto" or the "manual", a touch operation on portions of the operation screen OP labeled with "set" and "not set" becomes possible. When a touch operation is performed on "set", an input in the numeric keypad NK will be reflected in a frame F3. A numerical value input into the frame F3 indicates a "start time". The "start time" in the frame F3 indicates the start time of the first light emitting device 50 in the arrangement order among the light emitting devices 50 included in the group indicated by the "number indicating group of light emitting devices". Note that a unit of time that can be input into the frame F3 is hour, minute, and second, and it is possible to input 10:00:00 as illustrated in FIG. 4A, for example. The "start time" is set by the operator inputting an arbitrary numeric character into the frame F3. On the other hand, in a case where a touch operation is performed on the "not set", the "start time" is set in a state where nothing is input in the frame F3.

Figure 4B:
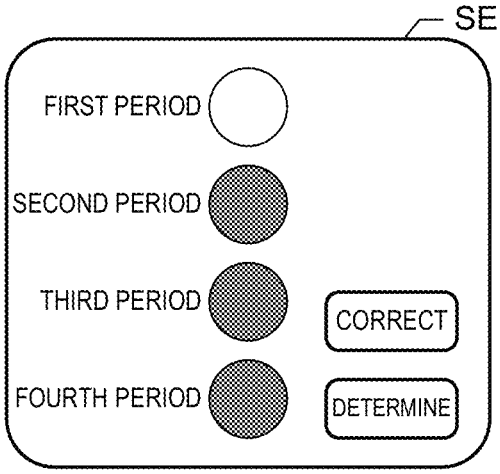
FIG. 4B is a diagram showing an example of a setting screen.

After the "start time" is set in the frame F3 by the "set" or the "not set" and then the determination key EK is input, the input in the numeric keypad NK will be reflected in a frame F4. The numerical value input into the frame F4 indicates the length per period among the periods included in the "lighting pattern". In FIG. 4A, the length per period is set to 0.3 seconds. After the numerical value is input into the frame F4 and then the determination key EK is input, the input in the numeric keypad NK will be reflected in a frame F5. The numerical value input into the frame F5 indicates the number of periods included in the "lighting pattern". In FIG. 4A, four periods are set as the number of periods included in the "lighting pattern". After a numerical value is input into the frame F5 and then the determination key EK is input, a setting screen SE (illustrated in FIG. 4B) in which the same number of circles as the number of periods included in the "lighting pattern" are arranged in the vertical direction is displayed on the operation screen OP. An inside of each circle is switched by a touch operation to either a white circle indicating the turn-on period or a black circle indicating the turn-off period. Therefore, the operator sets the turn-on period and the turn-off period constituting the "lighting pattern" by performing a touch operation on each circle displayed on the setting screen SE. When a touch operation is performed on a portion labeled with "determine" in the setting screen SE after the lighting pattern is set, the display of the user I/F unit 33 is switched from the operation screen OP to a confirmation screen CF1 illustrated in FIG. 5. Note that when a touch operation is performed on a portion labeled with "correct" in the setting screen SE, the input in the numeric keypad NK will be reflected again in the frame F4.

Figure 5:
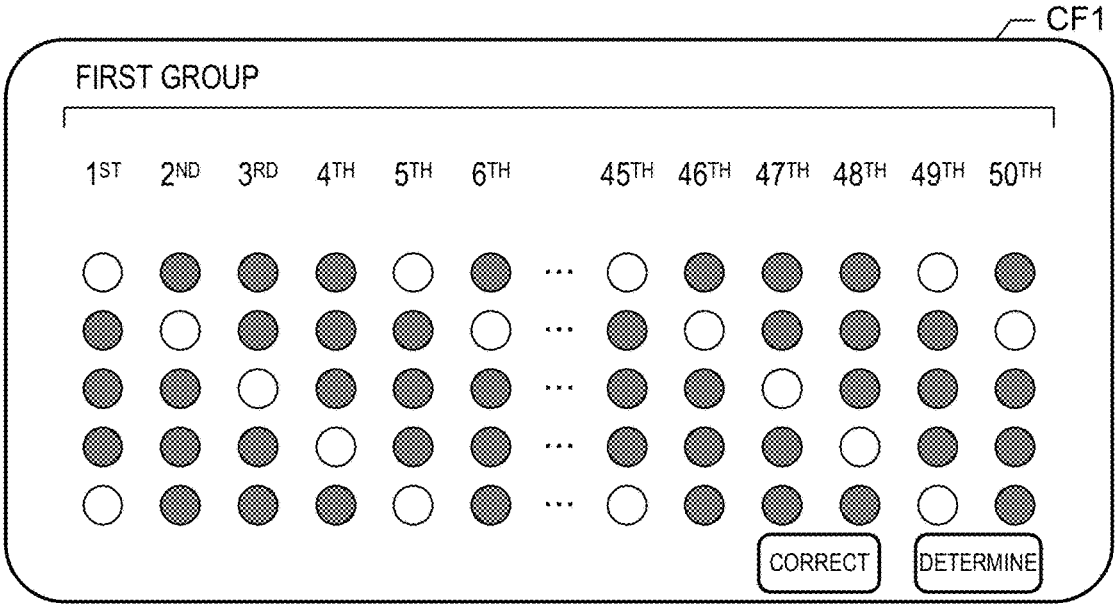
FIG. 5 is a diagram showing an example of a confirmation screen.

The confirmation screen CF1 illustrated in FIG. 5 is a screen for confirming contents of the group set using the operation screen OP. White circles and black circles illustrated as the lighting pattern of the respective light emitting devices 50 indicate the turn-on period and the turn-off period, as in the description in FIG. 3, and it is assumed that the time advances from the upper side to the lower side in the figure. For example, in the case of the first light emitting device 50, the lighting pattern makes one round of turn-on, turn-off, turn-off, and turn-off, and then repeats the cycle of turn-on, turn-off, turn-off, and turn-off again. In addition, in each of the light emitting devices 50, white circles or black circles having the same position in the vertical direction in the figure indicate the turn-on state or the turn-off state of each of the light emitting devices 50 at the same timing. For example, when the first light emitting device 50 is turned on, the second to fourth light emitting devices 50 are turned off, and the fifth light emitting device 50 is turned on.

When a touch operation is performed on the portion labeled with "determine" in the confirmation screen CF1, the start times of the second and subsequent light emitting devices 50 in the arrangement order are set on the basis of the start time of the first light emitting device 50 in the arrangement order by the function of the time calculation unit 21*c* described above. The start time of the first light emitting device 50 in the arrangement order is determined as follows. That is, when a touch operation is performed on the "set" at the "start time" in the operation screen OP, the numerical value input in the frame F3 is determined as the start time of the first light emitting device 50 in the arrangement order. On the other hand, when the touch operation is performed on the "not set" in the operation screen OP, a time obtained by adding a period TLg to a current time when the touch operation is performed on the portion labeled with the "determine" in the confirmation screen CF1 is determined as the start time of the first light emitting device 50 in the arrangement order. The period TLg is a time required to transmit the start time and the lighting pattern (lighting information) to each of the light emitting devices 50 included in one group. In one or more embodiments, the time required to transmit the start time and the lighting pattern to each of the 50 light emitting devices 50 is set as the period TLg. After the start time of each of the light emitting devices 50 is set, the lighting information including the start time and the lighting pattern calculated for each of the light emitting devices 50 included in the first group is transmitted to each of the light emitting devices 50 included in the first group by the function of the lighting control unit 21*d* described above. When a touch operation is performed on the "not set" in the operation screen OP, the start time of first light emitting device 50 in the arrangement order will immediately come after transmission of the lighting information. After the transmission of the lighting information, the display of the user I/F unit 33 returns from the confirmation screen CF1 to the operation screen OP. When a touch operation is performed on the portion labeled with the "correct" in the confirmation screen CF1, the operation screen OP and the setting screen SE are displayed again on the operation screen OP.

When a touch operation is performed on the portion labeled with "determine" in the confirmation screen CF1 and the screen returns from the confirmation screen CF1 to the operation screen OP, the input in the numeric keypad NK will be reflected again in the frame F1. At this time, only an input of 1 or 2 is permitted in the frame F1. That is, a numeric character different from 1 and 2, when input from the numeric keypad NK, is not reflected in the frame F1. When 2 is input into the frame F1, the second group is set such that the first group set on the previous operation screen OP and the second group set on the current operation screen OP cooperate with each other.

Figure 6A:
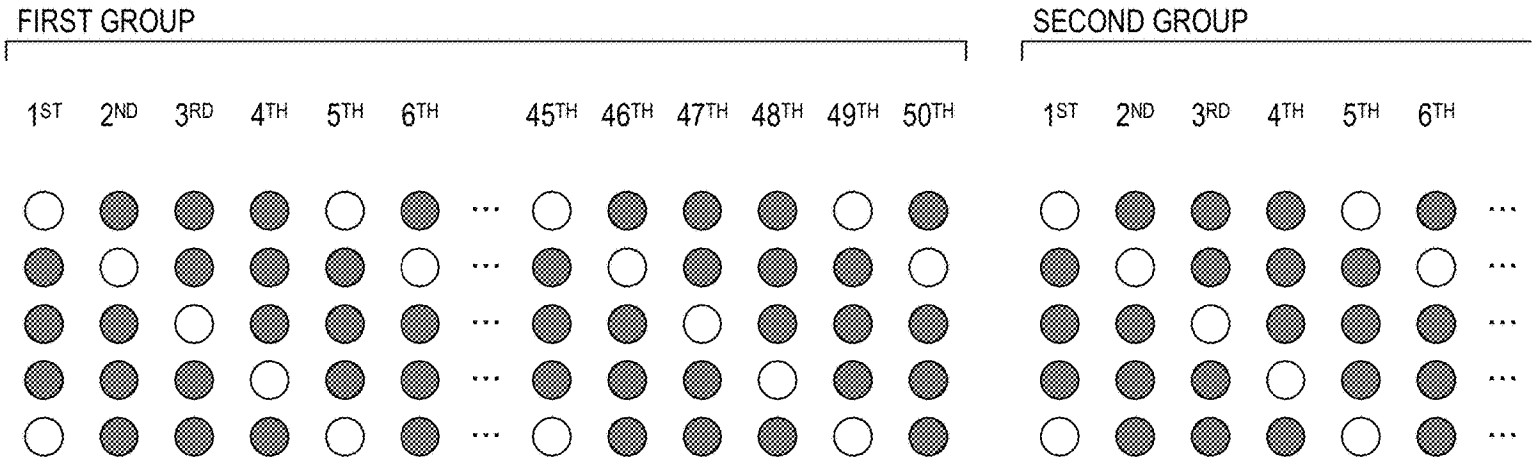
FIG. 6A is an explanatory diagram in a case where lighting of a second group is not cooperated with lighting of a first group.
Figure 6B:
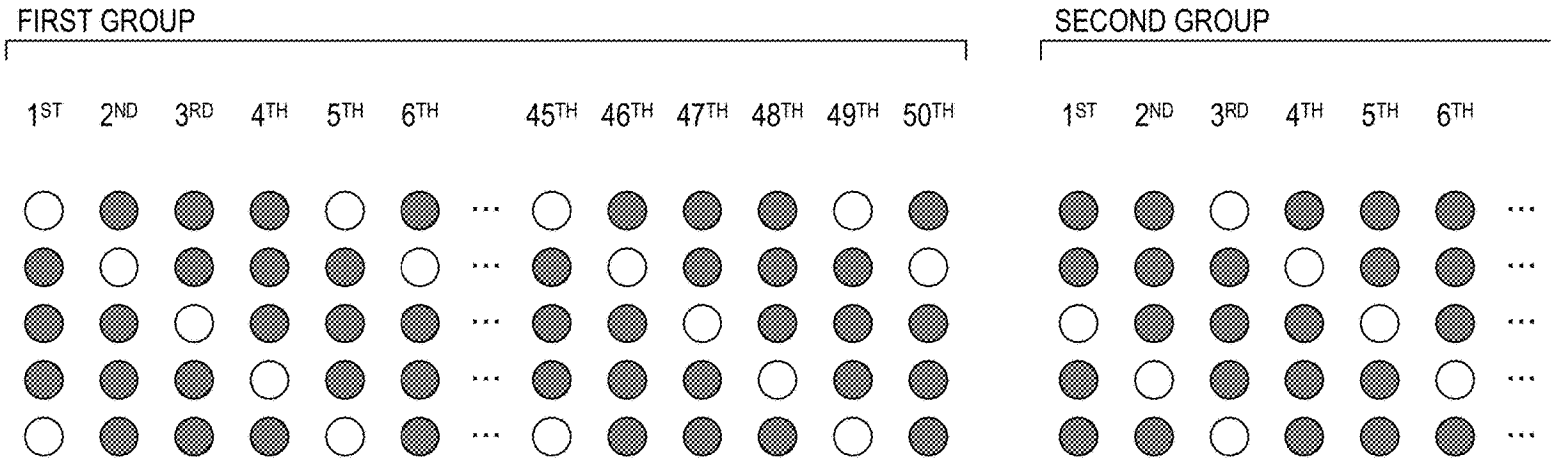
FIG. 6B is an explanatory diagram in a case where lighting of the second group is cooperated with lighting of the first group.

The cooperation will be described with reference to FIGS. 6A and 6B. FIG. 6A illustrates the turn-on and turn-off states of each of the light emitting devices 50, which change in time series, when the second group is not cooperated with the first group. On the other hand, FIG. 6B illustrates the turn-on and turn-off states of each of the light emitting devices 50, which change in time series, when the second group is cooperated with the first group. In FIGS. 6A and 6B, each of the first group and the second group is a group including the 50 light emitting devices 50.

In FIG. 6B, since the second group is cooperated with the first group, the first (first) light emitting device 50 of the second group is arranged next to the $50^{th}$ (last) light emitting device 50 of the first group. The first light emitting device 50 of the second group is turned on and off in a lighting pattern started at a timing delayed by one period as compared with the lighting pattern of the light emitting device 50 arranged one before (the $50^{th}$ light emitting device 50 of the first group). For this reason, the lighting position is visually recognized as if it is moving in an order from the first to $50^{th}$ light emitting devices 50 of the first group and the first to $50^{th}$ light emitting devices 50 of the second group, one by one. Such a state is a state in which the first group and the second group cooperate with each other. On the other hand, in FIG. 6A, the first light emitting device 50 of the second group is turned on and off in a lighting pattern started at a timing earlier by one period from the lighting pattern of the light emitting device 50 arranged one before ($50^{th}$ light emitting device 50 of the first group). Therefore, the lighting position is visually recognized as if it is moving at a constant speed, from the first to $50^{th}$ light emitting devices 50 of the first group, but the lighting position moved to the $50^{th}$ light emitting device 50 of the first group is visually recognized as if it disappears without moving to the first light emitting device 50 of the second group. Such a state is a state in which the first group and the second group do not cooperate with each other.

Return to the description of the operation screen OP in a case where 2 is input into the frame F1. The operation screen OP in this case is a screen for setting the number of light emitting devices 50 included in the second group cooperating with the first group and the start time of each of the light emitting devices 50. Hereinafter, the operation screen OP for second-group setting is referred to as a second-group operation screen OP, and the operation screen OP for first-group setting is referred to as a first-group operation screen OP. In the second-group setting using the second-group operation screen OP, a lighting pattern similar to the lighting pattern set in the first-group (configuration of the number of periods, the turn-on period, and the turn-off period) is set in each of the light emitting devices 50, so that contents of the frame F4 and the frame F5 are fixed to the same contents as those set in the first-group operation screen OP, and no new input is received. As is the case with the first-group operation screen OP, when a touch operation is performed on either one of the portions displayed as the "auto" and the "manual" in the operation screen OP after 2 is input into the frame F1, broadcast transmission (information to be transmitted includes one unused channel) from the control device 10 to the plurality of light emitting devices 50 is executed. Then, each of the light emitting devices 50 transmits device information to the control device 10 using the unused channel. Note that the control unit 20 refers to the device information DB 40*a* recorded in the recording medium 40, and decides whether the light emitting device 50 of the first group is not included in the light emitting devices 50 that have transmitted the device information to the control device 10. When the light emitting device 50 of the first group is included, the light emitting device 50 is not included in the targets for collecting the device information (which is not regarded as the light emitting device 50 included in the second group). Further, when an input is made in the second-group operation screen OP, the unused channel used for communication with the light emitting device 50 is different from an unused channel used for communication with the first group. That is, in one or more embodiments, the wireless channel used when the control device 10 and each of the light emitting devices 50 included in an m-lth group communicate with each other is different from the wireless channel used when the control device 10 and each of the light emitting devices 50 included in an mth group communicate with each other. For example, the wireless channel used when the control device 10 and each of the light emitting devices 50 included in the first group communicate with each other is different from the wireless channel used when the control device 10 and each of the light emitting devices 50 included in the second group communicate with each other. Therefore, the unused channels included in the information at the time of broadcast transmission from the control device 10 are different between the first group and the second group. As described above, since the wireless channel used when each group and the control device 10 communicate with each other is different for each group, it is possible to prevent the lighting information indicating the start time and the lighting pattern transmitted from the control device 10 from being transmitted to a wrong group.

After the "number of light emitting devices" is set, the arrangement order of the light emitting devices 50 corresponding to the "number of light emitting devices" included in the group indicated by the "number indicating group of light emitting devices" is determined by the function of the arrangement order determination unit 21*b* described above. After the arrangement order is determined, an input is made in the same portion as one of the "set" and the "not set" in the second-group operation screen OP in which the touch operation has been performed at the "start time" on the first-group operation screen OP. That is, when the touch operation has been performed on the "set" on the first-group operation screen OP, an input is made for the the "set" also on the second-group operation screen O, and when the touch operation is performed on the "not set" on the first-group operation screen OP, an input is made for the the "not set" also on the second-group operation screen OP.

In the second-group operation screen OP, when an input is made to the "set", an input in the numeric keypad NK will be reflected in the frame F3. Here, the numerical value input from the operator into the frame F3 corresponds to a temporarily set start time. The temporarily set start time referred to herein is a time temporarily set, by the operator, as a start time of a lighting pattern of the first light emitting device 50 in the $m^{th}$ (m is an arbitrary natural number of 2 or more, here m=2) group.

On the other hand, in the second-group operation screen OP, when an input is made to the "not set", the "start time" is set in a state where nothing is input in the frame F3.

Figure 7:
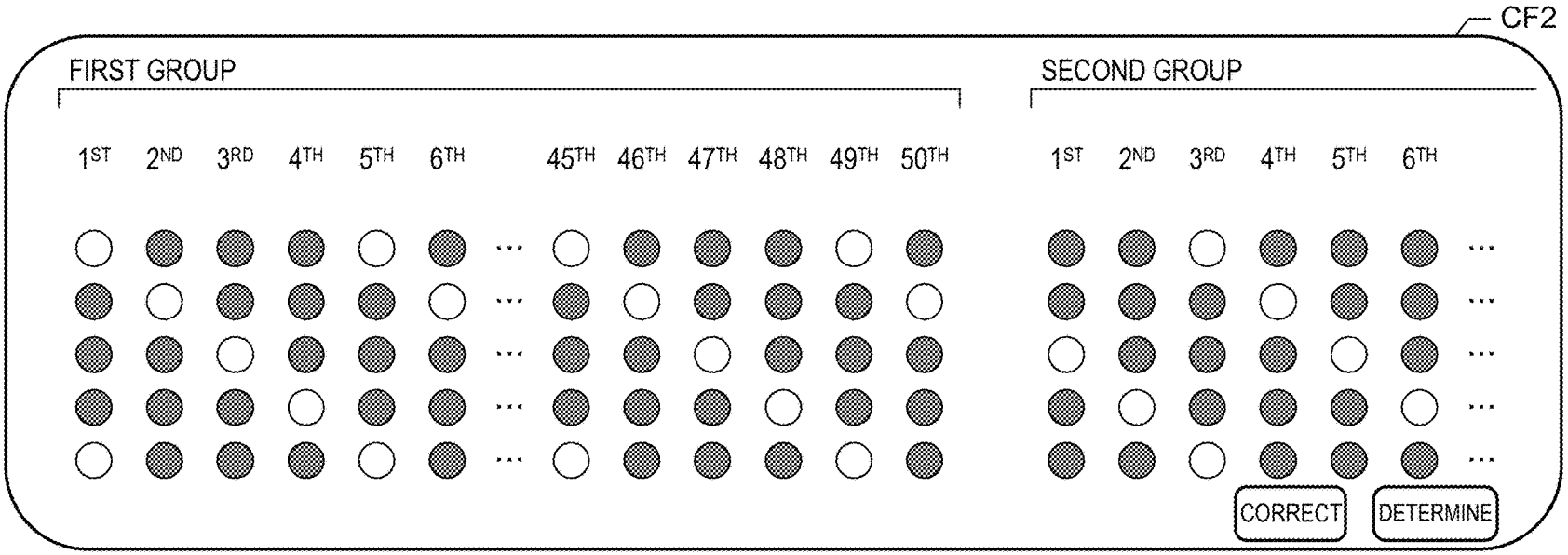
FIG. 7 is a diagram showing an example of the confirmation screen.

After the "start time" is set in the frame F3 by the "set" or the "not set" in the second-group operation screen OP and then the determination key EK is input, the display of the user I/F unit 33 is switched from the operation screen OP to the confirmation screen CF2 illustrated in FIG. 7. The confirmation screen CF2 is a screen for confirming contents set using the second-group operation screen OP. On the confirmation screen CF2, contents ranging from the contents of the first group to the contents of the group set using the second-group operation screen OP are displayed. When a touch operation is performed on the portion labeled with "correct" in the confirmation screen CF2, the screen returns to the operation screen OP, and the input in the numeric keypad NK will be reflected in the frame F1. Here, only an input of 1 or 2 is permitted in the frame F1.

When a touch operation is performed on the portion labeled with "determine" in the confirmation screen CF2, the start times of the second and subsequent light emitting devices 50 in the arrangement order are set on the basis of the start time of the first light emitting device 50 in the arrangement order by the function of the time calculation unit 21*c* described above. The start time of the first light emitting device 50 in the arrangement order is determined as follows. That is, in a case where an input is made to the "set" at the "start time" in the second-group operation screen OP, the control unit 20, which functions as the time calculation unit 21*c*, calculates a start time $T_m$1 of the first light emitting device of the mth group by using the following formula (I), when each of the light emitting devices 50 included in the mth group is turned on in cooperation with the m-lth group after the lighting information is transmitted to each of the light emitting devices 50 included in the m-lth group (m is an arbitrary natural number of 2 or more).

$$T_m1=T_11+RT+nST \quad \text{(I)}$$

$T_1$1: a start time of the first light emitting device 50 of first group S: a total number of turn-on periods and turn-off periods included in the lighting pattern T: a length (seconds) of the turn-on period and the turn-off period R: a remainder when the number of light emitting devices 50 included in the first to $m-1^{th}$ groups is divided by S.

n: an arbitrary natural number including 0

$T_1$1, RT, and nST constituting Formula (I) will be described. As described above, $T_1$1 is the start time of the first light emitting device 50 of the first group. In other words, the first light emitting device 50 of the first group starts the lighting pattern from the time indicated by $T_1$1. RT is a value indicating at least how many periods the first light emitting device 50 of the $m^{th}$ group should start the lighting pattern later than the start time ($T_1$1) of the first light emitting device 50 of the first group. For example, when the start time ($T_2$1) of the first light emitting device 50 of the second group is calculated using Formula (I), when the number of light emitting devices 50 included in the first group is 50 and the total number (=S) of the periods (the turn-on periods and the turn-off periods) included in the lighting pattern set in the first group is 4, as illustrated in FIG. 4A, a value of R is 50÷4 (=S)=12 . . . remainder 2 (=R).

Therefore, the lighting of the second group can be cooperated with the lighting of the first group if the first light emitting device 50 of the second group starts the lighting pattern at least 2 periods later than the start time of the first light emitting device 50 of the first group. In other words, if at least $T_2\mathbf{1}=T_1\mathbf{1}+RT$ (referred to as a coordination establishment conditional formula) is satisfied, the lighting of the second group can be coordinated with the light of the first group. Next, nST will be described. ST in nST is a length of one cycle in the lighting pattern. For example, in the case of FIG. 4A, the total number (=S) of the periods (the turn-on periods and the turn-off periods) included in the lighting pattern is 4 and the length (=T) per period is 0.3 seconds, and thus the length (=ST) of one cycle included in the lighting pattern is 1.2 seconds. As described above, n in nST is an arbitrary natural number including 0. Therefore, the value indicated by nST is a value obtained by multiplying the length of one cycle in the lighting pattern by n. Therefore, whatever natural number is substituted for n in the formula $T_2\mathbf{1}=T_1\mathbf{1}+RT+nST$ obtained by adding nST to the cooperation establishment conditional formula, the lighting of the second group can be cooperated with the lighting of the first group, as is the case with the above-described cooperation establishment conditional formula. Therefore, by using Formula (I), a start time $T_m\mathbf{1}$ of the first light emitting device of the $m^{th}$ group can be calculated such that the lighting of the $m^{th}$ group cooperates with the lighting of the $m-1^{th}$ group.

A case where the start time ($T_2\mathbf{1}$) of the first light emitting device 50 of the second group is calculated using Formula (I) will be described in detail. For example, when the number of light emitting devices 50 included in the first group is 50, the total number (=S) of the periods (the turn-on periods and the turn-off periods) included in the lighting pattern set in the first group is 4, and the length per period (the turn-on period and the turn-off period) is 0.3 seconds (=T), as illustrated in FIG. 4A, the value of R is 50÷4 (=S)=12 . . . remainder 2 (=R). When the start time $T_1\mathbf{1}$ of the first light emitting device 50 of the first group is set to 10:00:00, a start time $T_2\mathbf{1}$ of the first light emitting device of the second (=m) group is calculated as follows: $T_2\mathbf{1}$=10:00:00+2×0.3 (seconds)+n×4×0.3 (seconds). Then, the minimum time that satisfies Formula (I), among the times after the temporarily set start time input into the frame F3 is calculated as the start time of the first light emitting device 50 of the second group. At this time, a condition A that RT+nST is a natural number may be imposed on Formula (I). When m=2 (when the start time $T_2\mathbf{1}$ of the first light emitting device of the second group is calculated using Formula (I)), the first group to the $m-1^{th}$ group in the definition of R means the first group to the first group, and thus the number of light emitting devices 50 divided by S at this time is the number of light emitting devices 50 included in the first group. Further, when m=3 (when a start time $T_3\mathbf{1}$ of the first light emitting device of a third group is calculated using Formula (I)), since the first group to the $m-1^{th}$ group means the first group to the second group, and thus the number of light emitting devices 50 divided by S at this time is the total number of the light emitting devices 50 included in the first group and the second group.

On the other hand, when an input is made to the "not set" in the second-group operation screen OP, a current time when the touch operation is performed on the portion labeled with the "determine" in the confirmation screen CF2 is set as the temporarily set start time. Then, when the temporarily set start time is set, the control unit 20, which functions as the time calculation unit 21*c*, calculates n (an arbitrary natural number not including 0) that satisfies at least the following Formula (II) on the assumption that the temporarily set start time $T_m\mathbf{1}P$ of the first light emitting device 50 of the mth group is set.

$$(T_m1P-T_11)+TLg<RT+nST \quad \text{(II)}$$

TLg: a time required to transmit the lighting information to each of the light emitting devices 50 included in one group In one or more embodiments, the condition A is that RT+nST is a natural number is imposed when n satisfying Formula (II) is calculated. The start time $T_m\mathbf{1}$ is calculated by substituting n calculated in this manner into Formula (I). In one or more embodiments, a minimum value, among values of n that satisfy Formula (II) and the condition A, is substituted into Formula (I). As a case where n is calculated by Formula (II), for example, in a case where the start time $T_1\mathbf{1}$ of the first light emitting device 50 of the first group is 10:00:00, a temporarily set start time $T_2\mathbf{1}P$ of the first light emitting device 50 of the second group is 10:15:00, and the period TLg is 30 seconds, the formula (10:15:00−10:00:00)+30 seconds<2×0.3 (seconds)+n×4×0.3 (seconds) is obtained when the numerical values are applied to Formula (II). Further calculation shows that n>774.5, and the minimum value of n at which RT+nST is a natural number is 777. Then, when the minimum value of n (=777) is substituted into Formula (I), $T_2\mathbf{1}$=10:15:33 is calculated as a calculation result of $T_2\mathbf{1}$=10:00:00+2×0.3 (seconds)+n (=777)×4×0.3 (seconds). In this manner, the start time of the first light emitting device 50 of the second group is calculated using Formulas (I) and (II) and the condition A. When n calculated using Formula (II) and the condition A is substituted into Formula (I), a time (that is, time represented by X (hours):Y (minutes):Z (seconds):00) obtained by adding second (=RT+nST) represented by a natural number to $T_1\mathbf{1}$ is calculated as $T_{m1}\mathbf{1}$.

In the second-group operation screen OP, after the start time of each of the light emitting devices 50 is set, the lighting information including the start time and the lighting pattern calculated for each of the light emitting devices 50 included in the second group, as is the case with the first group, is transmitted to each of the light emitting devices 50 included in the second group by the function of the lighting control unit 21*d* described above. Thereafter, the display of the user I/F unit 33 returns from the confirmation screen CF2 to the operation screen OP, and the input in the numeric keypad NK will be reflected in the frame F1 again. Here, only an input of 1 or 3 is permitted in the frame F1. That is, a numeric character different from 1 and 3, when input from the numeric keypad NK, is not reflected in the frame F1. When 3 is input into the frame F1, the third group is set such that the second group set on the previous operation screen OP and the third group set on the current operation screen OP cooperate with each other. As described above, in a case where a value of a numerical value of 2 or more is input as the "number indicating group of light emitting devices" in a state where a value of a natural number of 2 or more is permitted in the frame F1, the start time can be set so as to cooperate with the previous group. In a case where the numerical value of 1 is input in the frame F1, the start time can be set without considering cooperation with the previous group.

Using the operation screen OP, the light emitting devices 50 arranged along the road are divided into groups, and the lighting pattern and the start time are set for each group. As described above, an upper limit of the number of light emitting devices 50 that can communicate with the control unit 20 at a time while the control unit 20 of the control device 10 executes the lighting control instruction 21 is 50. Therefore, for example, in a case of dividing the 100 light emitting devices 50 arranged along the road into two groups of 50 (the first group and the second group) and setting the start time such that the first group and the second group cooperate, it is necessary to transmit a signal indicating the setting contents to each of the first group and the second group. Therefore, the operator carrying the control device 10 should perform the first-group setting around the first group and then move to the periphery of the second group to perform the second-group setting. Specifically, around the first group, 1 is input into the frame F1 of the operation screen OP to perform various settings of the first group, and then, around the second group, 2 is input into the frame F1 of the operation screen OP to perform various settings of the second group.

According to the configuration described above, the arrangement order of the light emitting devices 50 is determined on the basis of the device information. Therefore, the light emitting devices 50 can be easily turned on in the lighting pattern corresponding to the arrangement order of the light emitting devices 50.

Further, according to the above configuration, when each of the light emitting devices 50 included in the mth group is turned on in cooperation with the $m-1^{th}$ group, the start time of the first light emitting device 50 of the mth group is calculated using Formula (I). Therefore, labor for the operator himself/herself to adjust the timing at which each of the last light emitting device 50 in the arrangement order in the $m-1^{th}$ group and the first light emitting device 50 in the arrangement order in the $m^{th}$ group starts repetition of the lighting pattern in order to turn on in cooperation with the $m-1^{th}$ group. In addition, the start times of the second and subsequent light emitting devices 50 of the mth group are calculated by adding T to the start time of the light emitting device 50 arranged one before the light emitting device 50. Therefore, when the start time of the first light emitting device 50 of the $m^{th}$ group is calculated, the start times of the second and subsequent light emitting devices 50 of the same group can also be calculated.

Furthermore, according to the above configuration, in a case where the temporarily set start time of the first light emitting device 50 of the mth group is set, n (an arbitrary natural number not including 0) satisfying at least Formula (II) is calculated, the calculated n is substituted into Formula (I) so that the start time of the light emitting device 50 is calculated. Therefore, it is possible to prevent the m-lth group and the mth group from being unable to cooperate with each other due to the fact that it takes time to transmit the lighting information to each of the light emitting devices 50 included in one group.

(2) Lighting Setting Process

Figure 8:
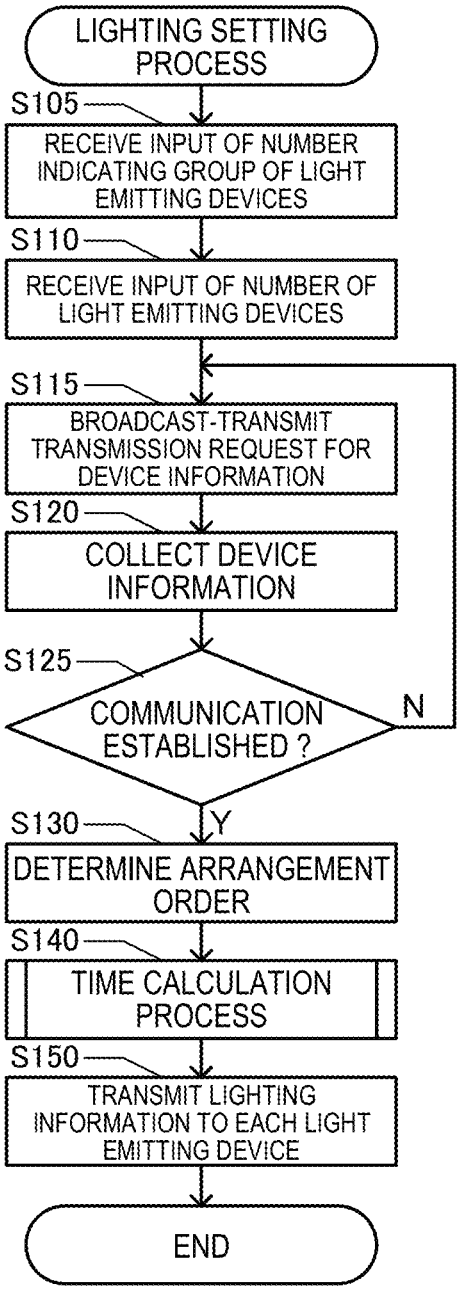
FIG. 8 is a flowchart of lighting setting process.

Next, lighting setting process executed by the control device 10 will be described with reference to a flowchart illustrated in FIG. 8. The lighting setting process is executed when the light emitting devices 50 arranged along the road are divided into several groups and the lighting pattern and the start time are set for each group. When the lighting setting process is started, the control unit 20 of the control device 10 receives an input of the number m indicating the group of the light emitting devices 50 (step S105). Specifically, an input in the numeric keypad NK will be reflected in the frame F1 of the operation screen OP. Next, the control unit 20 receives an input of the number of light emitting devices 50 included in the group (step S110). Specifically, a touch operation for selecting the "auto" or the "manual" on the operation screen OP or an input using the numeric keypad NK (input of a numerical value into the frame F2 when the "manual" is selected) is received.

Next, by functioning as the information collection unit 21*a*, the control unit 20 broadcast-transmits a transmission request for device information and information indicating the control device ID which is information for identifying the control device 10, from the control device 10 to the plurality of light emitting devices 50 (step S115). At this time, the information also includes one unused channel detected from among a plurality of wireless channels that can be used by the control device 10.

Next, by functioning as the information collection unit 21*a*, the control unit 20 collects device information including position information indicating each of the light emitting devices 50 from each of the light emitting devices 50 that have received the broadcast-transmitted information (step S120). The collected device information is recorded in the recording medium 40. The light emitting device ID is recorded with a corresponding an unused channel for use in communication with the light emitting device 50 indicated in the light emitting device ID. At this time, the number of light emitting devices 50 from which the device information is collected is determined according to which one of the "auto" and the "manual" in the operation screen in FIG. 4A has been touched.

Next, the control unit 20 decides whether communication has been established (step S125). Specifically, after performing broadcast transmission (including information on an unused channel) in step S115, the control unit 20 decides whether communication has been established on the basis of whether there has been a return of device information from the light emitting device 50 using the unused channel. When the communication has not been established (step S125: NO), the control unit 20 executes the process of step S115 again. At this time, information indicating that communication has not been established may be displayed on the operation screen OP of FIG. 4A, and a selection screen for selecting whether to re-execute the collection of the device information may be displayed. On the other hand, when the communication has been established (step S125: YES), the number of light emitting devices 50 included in the group is input into a frame F2 of the operation screen OP.

When the communication has been established (step S125: YES), by functioning as the arrangement order determination unit 21*b*, the control unit 20 determines the arrangement order of the light emitting devices 50 on the basis of the collected device information. (Step S130). The arrangement order is recorded in the RAM of the control device 10.

After the arrangement order of the light emitting devices 50 is determined (step S130), by functioning as the time calculation unit 21*c*, the control unit 20 performs time calculation process, thereby setting the start time of each of the light emitting devices 50 included in the $m^{th}$ (number m input in step S105) group (step S140). Details of the time calculation process in step S140 will be described with reference to FIG. 9.

Next, by functioning as the lighting control unit 21*d*, the control unit 20 transmits the lighting information including the start time to each of the light emitting devices 50 (step S150). Specifically, the control unit 20 refers to the light emitting device ID recorded in the device information DB 40*a*, and transmits the lighting information including the start time calculated for each of the light emitting devices 50 to each of the light emitting devices 50 via the wireless communication unit 31. In one or more embodiments, the lighting information includes the lighting pattern in addition to the start time. After transmitting the lighting information (step S150), the control unit 20 ends the lighting setting process.

Figure 9:
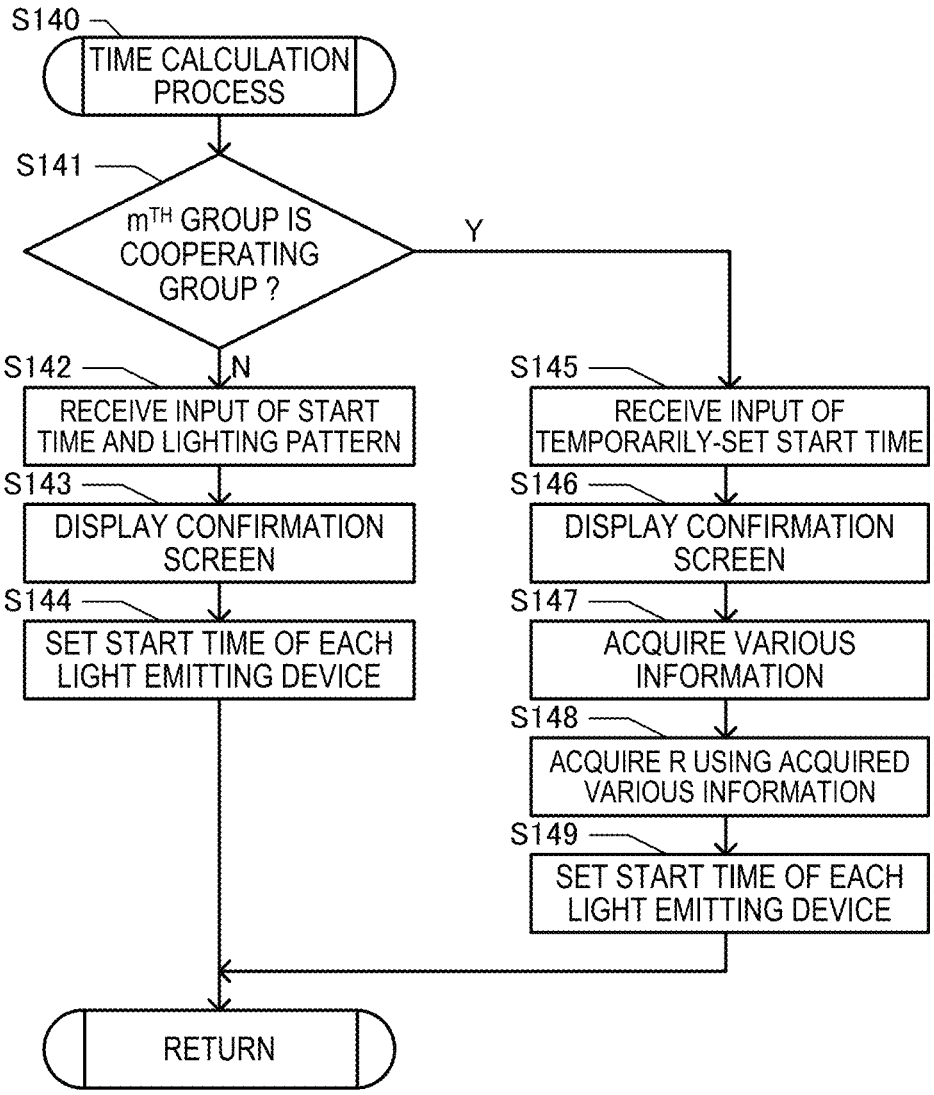
FIG. 9 is a flowchart of time calculation process.

The time calculation process in step S140 will be described in detail with reference to the flowchart illustrated in FIG. 9. The time calculation process in step S140 includes steps S141 to S149 which will be described below. While the time calculation process is being executed, the control unit 20 functions as the time calculation unit 21*c*. In the time calculation process, first, the control unit 20 decides whether the $m^{th}$ group is a cooperating group (step S141). Specifically, the control unit 20 refers to the number m input in the frame F1 of the operation screen OP in step S105, and when the number m is 1, the group is decided to be a non-cooperating group, and when the number m is 2 or more, the group is decided to be a cooperating group. The cooperating group is a group cooperating with the previous group, and when the number m is 2, the second group cooperates with the first group.

When the group is decided to be a non-cooperating group (step S141: NO), control unit 20 receives an input regarding the start time (the start time of the first light emitting device 50 of the first group) and the lighting pattern (step S142). Specifically, a touch operation (selection of the "set" or the "not set") for input into the frame F3 of the first-group operation screen OP or an input using the numeric keypad NK (input of a numerical value into the frame F3 when the "set" is selected) is received. In addition, inputs by the numeric keypad NK into the frame F4 and the frame F5 of the first-group operation screen OP and a touch operation on the setting screen SE are received.

Next, the control unit 20 causes the user I/F unit 33 to display a confirmation screen (step S143). The content of the screen displayed as the confirmation screen is a screen (confirmation screen CF1 in FIG. 5) showing the contents of the first-group setting. When the touch operation is performed on the portion labeled with "determine" in the confirmation screen, the control unit 20 executes the next step S144.

The control unit 20 sets the start time of each of the light emitting devices 50 included in the first group (step S144). Specifically, when a touch operation is performed on the "set" at the "start time" in the first-group operation screen OP, the control unit 20 sets the numerical value input in the frame F3 as the start time of the first light emitting device 50 in the arrangement order, and then sets the start times of the second and subsequent light emitting devices 50 in the arrangement order. On the other hand, when the touch operation is performed on the "not set" in the first-group operation screen OP, the control unit 20 determines a time obtained by adding the period TLg to a current time when the touch operation is performed on the portion labeled with the "determine" in the confirmation screen as the start time of the first light emitting device 50 in the arrangement order, and then sets the start times of the second and subsequent light emitting devices 50 in the arrangement order. The start times of the second and subsequent light emitting devices 50 in the arrangement order are calculated by adding T to the start time of the light emitting device 50 arranged one before from the light emitting device 50. Thereafter, after finishing the time calculation process, the control unit 20 executes the process of step S150 and subsequent steps in FIG. 8.

On the other hand, when the group is decided to be a cooperating group (step S141: YES), the control unit 20 receives an input regarding the temporarily set start time (step S145). Specifically, an input is made in the same portion as one of the "set" and the "not set" in the $m^{th}$ ($m \geq 2$)-group operation screen OP in which the touch operation has been performed at the "start time" on the $m-1^{th}$-group operation screen OP. When the portion is the "set", the input in the numeric keypad NK for inputting the temporarily set start time into the frame F3 is received. On the other hand, when the portion is the "not set", nothing is input into the frame F3.

Next, the control unit 20 causes the user I/F unit 33 to display a confirmation screen (step S146). The contents of the screen displayed as the confirmation screen are screens (for example, the confirmation screen CF2 in FIG. 7) indicating the setting contents of the first to $m^{th}$ groups. When the touch operation is performed on the portion labeled with "determine" in the confirmation screen, the control unit 20 executes the next step S147.

The control unit 20 acquires various types of information (step S147). The various types of information as used herein include the number of light emitting devices 50 included in the first group to $m-1^{th}$ group, the start time of the first light emitting device 50 of the first group, and the lighting pattern used for lighting of the $m-1^{th}$ group. Using the acquired various types of information, the control unit 20 calculates the remainder R in a case where the number of light emitting devices 50 included in the first group to the $m-1^{th}$ group is divided by the total number S of the turn-on periods and the turn-off periods included in the lighting pattern (step S148). For example, when the number is 50 and the total number S is 4, the value of R is 50÷4 (=S)=12 . . . remainder 2 (=R).

Next, the start time of each of the light emitting devices 50 included in the $m^{th}$ group is set (step S149). Specifically, when a touch operation is performed on the "set" at the "start time" in the mth-group operation screen OP, the control unit 20 first calculates, as the start time of the first light emitting device 50 in the $m^{th}$ group, the minimum time satisfying Formula (I) among the times after the temporarily set start time input in the frame F3. The start times of the second and subsequent light emitting devices 50 in the arrangement order are then calculated by adding T to the start time of the light emitting device 50 arranged one before from the light emitting device 50. On the other hand, when an input is made to the "not set" at the "start time" in the $m^{th}$ group operation screen OP, the control unit 20 first sets, as the temporarily set start time, a current time when the touch operation is performed on the portion labeled with "enter" in the confirmation screen. Next, n satisfying Formula (II) and the condition A is calculated, and a minimum value, among the calculated values of n, is substituted into Formula (I) to calculate the start time of the first light emitting device 50 of the $m^{th}$ group. The start times of the second and subsequent light emitting devices 50 in the arrangement order are then calculated by adding T to the start time of the light emitting device 50 arranged one before from the light emitting device 50. Thereafter, after finishing the time calculation process, the control unit 20 executes the process of step S150 and subsequent steps in FIG. 8.

(3) Lighting Execution Process

Figure 10:
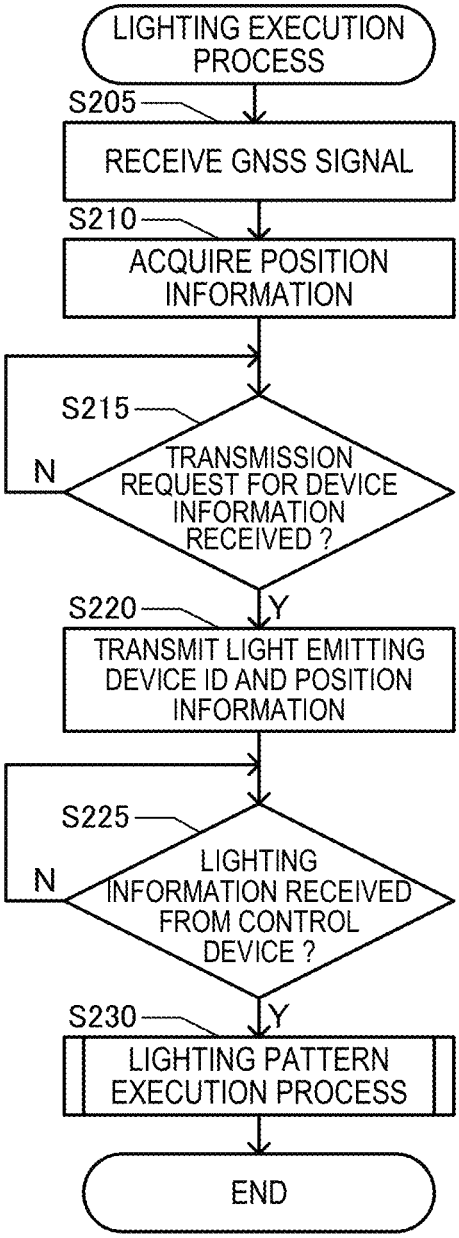
FIG. 10 is a flowchart of lighting execution process.

Next, lighting execution process executed by the light emitting device 50 will be described with reference to a flowchart illustrated in FIG. 10. The lighting execution process is executed when the light emitting device 50 turns on and off the lighting unit 75 using the start time and the lighting pattern. When the lighting execution process is started, the control unit 60 of the light emitting device 50 causes the GNSS reception unit 73 to receive a signal of the Global Navigation Satellite System (step S205), and then, acquires position information indicating the position of the light emitting device 50 based on the output signal (step S210).

Next, the control unit 60 decides whether a transmission request for device information broadcast-transmitted from the control device 10 has been received (step S215). When the transmission request is received (step S215: YES), the control unit 60 transmits the device information including the position information of the light emitting device 50 and the light emitting device ID to the control device 10 using one unused channel included in the broadcast-transmitted information (step S220).

Next, by functioning as the lighting information acquisition unit 61*a*, the control unit 60 decides whether the lighting information including the start time and the lighting pattern transmitted from the control device 10 has been received via the wireless communication unit 71 (step S225). When it is decided that the lighting information has been received (step S225: YES), the control unit 60 records the acquired lighting information in the lighting information DB 80*a*.

Next, by functioning as the lighting execution unit 61*b*, the control unit 60 performs the lighting pattern execution process, thereby causing the lighting unit 75 to execute turn-on and turn-off according to the lighting pattern (step S230). Details of the lighting pattern execution process in step S230 will be described with reference to FIG. 11. After executing the lighting pattern execution process (S230), the control unit 60 ends the lighting execution process.

Figure 11:
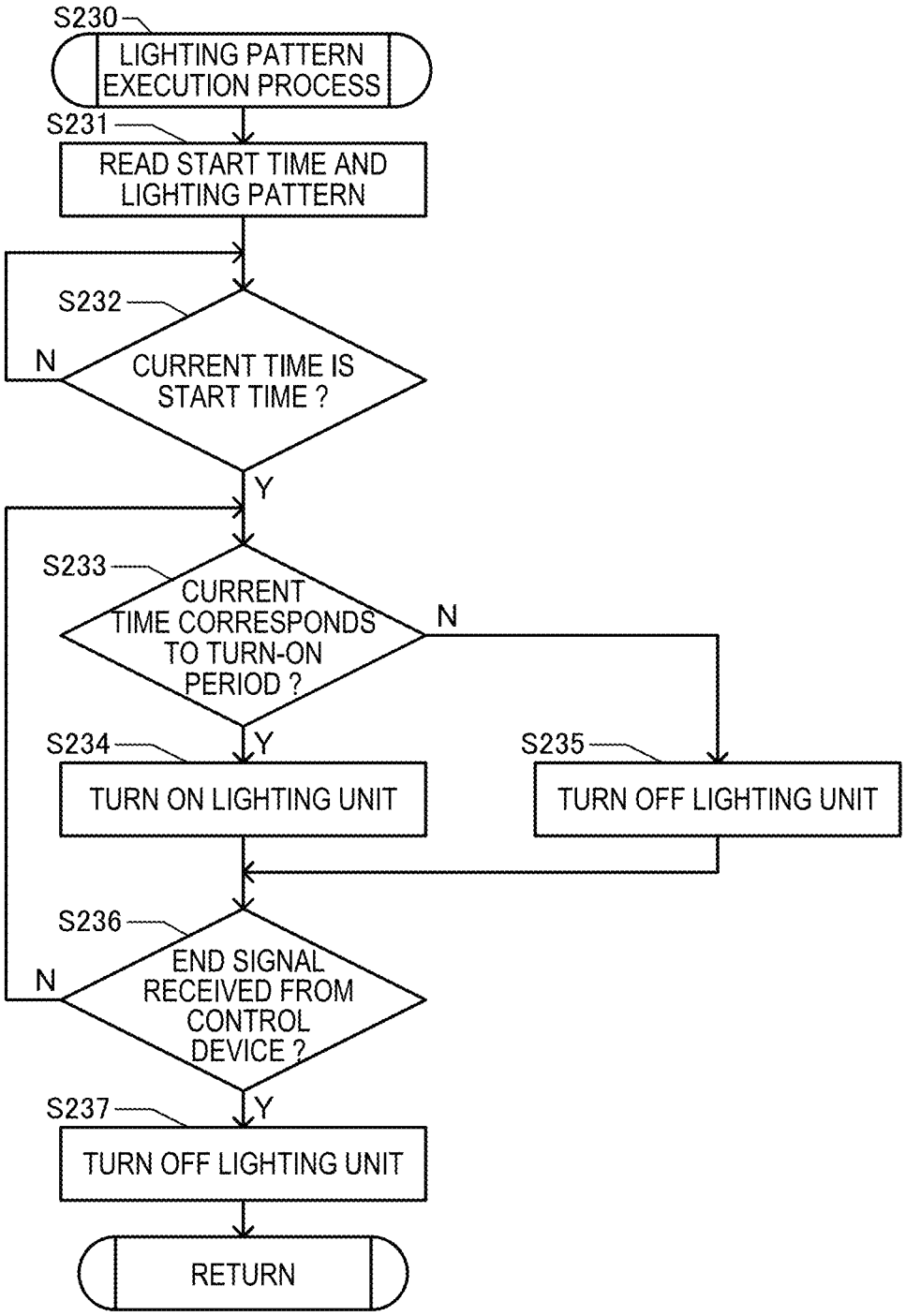
FIG. 11 is a flowchart of lighting pattern execution process.

The lighting pattern execution process in step S230 will be described in detail with reference to the flowchart illustrated in FIG. 11. The time calculation process in step S230 includes steps S231 to S237 which will be described below. While the lighting pattern execution process is executed, the control unit 60 functions as the lighting execution unit 61*b*. When the lighting pattern execution process is executed, first, the control unit 60 of the light emitting device 50 reads the start time and the lighting pattern (step S231). Specifically, the control unit 60 refers to the lighting information DB 80*a* recorded in the recording medium 80 and reads the start time and the lighting pattern.

Next, the control unit 60 decides whether the current time is the start time (step S232). Specifically, the control unit 60 refers to a clocking circuit (not illustrated) included in the light emitting device 50, and decides whether the current time is the start time. Then, when the current time is the start time (step S232: YES), the control unit 60 starts repetition of the lighting pattern and decides whether the current time corresponds to the turn-on period (step S233). Specifically, the control unit 60 refers to the clocking circuit to calculate the time which has elapsed from the start time to the current time, and refers to the lighting pattern to decide whether the current time corresponds to the turn-on period or the turn-off period. Then, when the current time corresponds to the turn-on period (step S233: YES), the control unit 60 turns on the lighting unit 75 (step S234), and when the current time corresponds to the turn-off period (step S233: NO), the control unit 60 turns off the lighting unit 75 (step S235). In a case where step S234 is executed in a state where the lighting unit 75 is turned on, the turn-on state is continued, and in a case where step S235 is executed in a state where the lighting unit 75 is turned off, the turn-off state is continued.

After turning on or off the lighting unit 75 (step S234 or S235), the control unit 60 decides whether an end signal instructing to end the lighting pattern has been received from the control device 10 (step S236). When the end signal has not been received (step S236: NO), the control unit 60 executes the process of step S243 and subsequent steps again. On the other hand, when the end signal has been received (step S246: YES), the control unit 60 turns off the lighting unit 75 (step S247), ends the lighting pattern execution process (S240), and then also ends the lighting execution process in FIG. 10.

(4) Other Embodiments

The information collection unit only needs to be able to collect device information from a plurality of light emitting devices that are repeatedly turned on and off in a lighting pattern in which a turn-on period and a turn-off period within one cycle are defined. In the above-described embodiments, the lighting pattern is a pattern including four periods in which the length of one period is 0.3 seconds, in which the lighting unit is turned on and off in the order of the turn-on period continuing for 0.3 seconds and the turn-off period continuing for 0.9 seconds, but the embodiments of the present invention are not limited thereto. For example, the length of one period may be different from 0.3 seconds, and the total number of the periods included in the lighting pattern may also be different from 4. In addition, the lighting pattern may be a pattern in which the turn-on period and the turn-off period having the same length are alternately repeated, or a proportion of the turn-on period in the lighting pattern may be higher than the proportion of the turn-off period.

The lighting pattern is set by the frame F4 and the frame F5 of the operation screen OP and the setting screen SE, but the embodiments of the present invention are not limited thereto. For example, predetermined 10 lighting patterns numbered may be recorded in advance in the control device 10 and each of the light emitting devices 50, and the lighting pattern may be set by designating the predetermined lighting pattern number on the operation screen OP.

The arrangement order determination unit only needs to be able to determine the arrangement order of the light emitting devices based on the device information. In the embodiments described above, the arrangement order of the light emitting devices 50 is determined with reference to the correspondence table in which the numbers of the light emitting devices 50 (the numbers displayed on the surfaces of the cones in FIG. 1) and the light emitting devices ID are associated with each other, but the embodiments of the present invention are not limited thereto. For example, when the control device 10 has map information including data for specifying a shape of a road, the road on which the light emitting devices 50 are arranged may be specified from the position of each of the light emitting devices 50, and the arrangement order of each of the light emitting devices 50 may be determined from the shape of the road. Furthermore, the arrangement order may be determined by specifying adjacent another light emitting device 50 for each of the light emitting devices 50 arranged along the road. Such adjacent another light emitting devices 50 are, for the light emitting device 50 arranged at an end position among the arranged light emitting devices 50, another light emitting device 50 located closest to the light emitting device 50, and, for the light emitting device 50 arranged at a position different from the end among the arranged light emitting devices 50, another light emitting device 50 located closest to the light emitting device 50 and another light emitting device 50 located second closest thereto. The arrangement order can be determined by specifying any other adjacent light emitting device 50 for each of the light emitting devices 50, and then numbering the light emitting devices 50 according to the order of adjacency from the light emitting device 50 arranged at an end position. At this time, of the two light emitting devices 50 arranged at the end position, the light emitting device 50 serving as the starting point may be designated by the operator via the user I/F unit 33, or may be the light emitting device 50 located at a position closer to the control device 10.

The time calculation unit only needs to be able to calculate the start time at which each of the light emitting devices starts repetition of the lighting pattern using the arrangement order. In one or more embodiments, when the temporarily set start time $T_m$1P of the first light emitting device 50 in the $m^{th}$ group is set, the minimum value, among values of n satisfying Formula (II) and the condition A, is substituted into Formula (I), but the embodiments of the present invention are not limited thereto. For example, a non-minimum value, among the calculated values of n, may be substituted into Formula (I). In addition, n to be substituted into Formula (I) may be calculated using only Formula (II) without imposing the condition A. In such a case, in a case where the start time $T_1$1 of the first light emitting device 50 of the first group is 10:00:00, the temporarily set start time $T_2$1P of the first light emitting device 50 of the second group is 10:15:00, and the period TLg is 30 seconds, n>774.5 and the minimum value among the values of n (arbitrary natural numbers including 0) is 775 when the numerical values are applied to Formula (II). Then, when the minimum value of n (=775) is substituted into Formula (I), $T_2$1=10:15:30:6 is calculated as a calculation result of $T_2$1=10:00:00+2×0.3 (seconds)+n (=775)×4×0.3 (seconds). When n calculated using only Formula (II) without imposing the condition A is substituted into Formula (I), a time (which is not necessarily X (hours):Y (minutes):Z (seconds):00) obtained by adding RT+nST (seconds) to $T_1$1 is calculated as $T_m$1.

In the embodiments described above, as Formula (I) and formula (II), the following formulae are used:

$$T_m1=T_11+RT+nST \quad \text{(I)}$$

$$(T_m1P-T_11)+TLg<RT+nST \quad \text{(II)}.$$

However, the embodiments of the present invention are not limited thereto. For example, $T_m$1 may be calculated by substituting n calculated using the following formula (IV) instead of Formula (II) into Formula (III):

$$T_m1=T_{m-1}1+RT+nST \quad \text{(III)}$$

$$(T_m1P-T_{m-1}1)+TLg<RT+nST \quad \text{(IV)}.$$

That is, in Formula (II), n is calculated using a difference between the temporarily set start time $T_m$1P of the first light emitting device 50 of the $m^{th}$ group and the start time $T_1$1 of the first light emitting device 50 of the first group. However, n may be calculated using a difference between the temporarily set start time $T_{m1}$P of the first light emitting device 50 of the $m^{th}$ group and the start time $T_{m-1}$1 of the first light emitting device 50 in the $m-1^{th}$ group, as for Formula (IV). When Formula (IV) is used, the condition A or a condition B (nST is a natural number) may be imposed. The condition B may be imposed not only on Formula (IV) but also on Formulas (I), (II), and (III). However, R in the case of using Formulas (III) and (IV) is a remainder when the number of light emitting devices 50 included in the $m-1^{th}$ group is divided by S.

In the above-described embodiments, the first start time of the second group is calculated using only Formula (I) in a case where an input is made to the "set" on the second-group operation screen OP, and the first start time of the second group is calculated using Formulas (I) and (II) in a case where an input is made to the "not set". However, the embodiments of the present invention are not limited thereto. For example, also when an input is made to the "set", the first start time of the second group may be calculated using Formulas (I) and (II).

In the above-described embodiments, the broadcast transmission is executed after the touch operation is performed on the "auto" in the operation screen OP, or after the touch operation to the "manual" and the input into the frame F2 by the numeric keypad NK are performed and the determination key EK is input, but the embodiments of the present invention are not limited thereto. For example, when a touch operation is performed on the "auto", or when a touch operation on the "manual" and an input into the frame F2 by the numeric keypad NK are performed and then the determination key EK is input, and then a touch operation is performed on the portion labeled with "determine" in the setting screen SE, broadcast transmission may be executed and a value to be input into the frame F2 may be determined.

In the above-described embodiments, the start times of the second and subsequent light emitting devices 50 in the arrangement order are calculated by adding T to the start time of the light emitting device 50 arranged one before from the light emitting device 50, but the embodiments of the present invention are not limited thereto. For example, the start times of all the second and subsequent light emitting devices 50 included in the same group may be set to the same time as the start time of the first light emitting device 50 of the same group. In such a case, the lighting information transmitted from the control device 10 to each of the light emitting devices 50 includes start period information indicating from which period of the periods included in the lighting pattern each of the light emitting devices 50 should be started the lighting pattern at the start time. For example, when the lighting pattern is set as illustrated in FIG. 3, lighting information including start period information indicating that the lighting pattern is started from the first period (turn-on period) as the start period at the start time is transmitted to the first light emitting device 50 of the same group (see the first light emitting device of the first group in FIG. 6B). In addition, lighting information including start period information indicating that the lighting pattern is started from the fourth period (turn-off period) as the start period at the start time is transmitted to the second light emitting device 50 of the same group (see the second light emitting device of the first group in FIG. 6B). Further, lighting information including start period information indicating that the lighting pattern is started from the third (second) period (turn-off period) as the start period at the start time is transmitted to the third (fourth) light emitting device 50 of the same group (see the third (fourth) light emitting device of the first group in FIG. 6B). That is, the first period, among the periods included in the lighting pattern, is allocated to the start period indicated by the start period information of the first light emitting device 50 in the arrangement order, and the previous period to the period indicated as the start period of the light emitting device 50 arranged one before the light emitting device 50 is allocated to the start period indicated by the start period information of the second and subsequent light emitting devices 50 in the arrangement order as the start period. Each of the light emitting devices 50 included in one group from which the lighting information including such start period information has been received starts execution of the lighting pattern by the lighting unit 75 with the same time as the start time. Since the start periods indicated by the start period information received by the respective light emitting devices 50 are different from each other, each of the light emitting devices 50 can execute the lighting pattern at a timing delayed by one period as compared with the lighting pattern of the light emitting device 50 arranged one before (see the first group in FIG. 6B).

Furthermore, as one or more embodiments in the present invention, the method of determining the arrangement order of the light emitting devices on the basis of the device information can also be applied as instructions or a method. In addition, a change can be made as appropriate such that a part is software and a part is hardware. Further, one or more embodiments of the present invention are also established as a recording medium storing instructions for controlling the device. Of course, the recording medium of the software may be a magnetic recording medium or a semiconductor memory, and can be considered exactly the same in any recording medium to be developed in the future. Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A control device that controls a plurality of light emitting devices, the control device comprising:

a controller that:

collects device information from the light emitting devices that are repeatedly turned on and off in a lighting pattern, wherein a turn-on period and a turn-off period are defined within a cycle in the lighting pattern;

determines an arrangement order of the light emitting devices based on the device information;

calculates a start time at which each of the light emitting devices starts repetition of the lighting pattern using the arrangement order; and transmits lighting information including the start time to each of the light emitting devices and causes each of the light emitting devices to start the repetition of the lighting pattern.

2. The control device according to claim 1, wherein when each of the light emitting devices of a $m^{th}$ group is turned on in cooperation with a $m-1^{th}$ group after the lighting information is transmitted to each of the light emitting devices of the $m-1^{th}$ group where m is an arbitrary natural number of 2 or more, the controller calculates the start time of a first light emitting device among the light emitting devices of the $m^{th}$ group using following formula (I):

$$T_m1=T_11+RT+nST \quad \text{(I)}$$

where $T_m$1 is the start time of the first light emitting device of the mth group;

$T_1$1 is the start time of the first light emitting device of a first group;

R is a remainder when the number of the light emitting devices of the first group to the $m-1^{th}$ group is divided by S;

T is a length of the turn-on period or the turn-off period;

n is an arbitrary natural number including 0; and

S is a total number of the turn-on period and the turn-off period included in the lighting pattern.

3. The control device according to claim 1, wherein the control device communicates with the light emitting devices using a wireless channel; and the wireless channel used in communicating with the light emitting devices of $m-1^{th}$ group is different from the wireless channel used in communicating with the light emitting devices of $m^{th}$ group communicate where m is an arbitrary natural number of 2 or more.

4. The control device according to claim 2, wherein when the start time of the first light emitting device of the $m^{th}$ group is temporarily set, the controller calculates n (an arbitrary natural number not including 0) satisfying the following formula (II):

$$(T_m1P-T_11)+TLg<RT+nST \quad \text{(II)}$$

where $T_m$1P is the temporarily set start time of the first light emitting device of the $m^{th}$ group; and TLg is a time required to transmit the lighting information to each of the light emitting devices of one group, wherein the start time $T_m$1 of the first light emitting device of the $m^{th}$ group is calculated by substituting the calculated n into Formula (I).

5. A control method for controlling a plurality of light emitting devices that are repeatedly turned on and off in a lighting pattern, wherein a turn-on period and a turn-off period are defined within a cycle in the lighting pattern, the method comprising:

collecting device information from the light emitting devices;

determining an arrangement order of the light emitting devices based on the device information;

calculating a start time at which each of the light emitting devices starts repetition of the lighting pattern using the arrangement order; and transmitting lighting information including the start time to each of the light emitting devices and causing each of the light emitting devices to start the repetition of the lighting pattern.

6. A non-transitory computer readable recording medium storing instructions that cause a computer to execute:

collecting device information from a plurality of light emitting devices that are repeatedly turned on and off in a lighting pattern, wherein a turn-on period and a turn-off period are defined within a cycle in the lighting pattern;

determining an arrangement order of the light emitting devices based on the device information;

calculating a start time at which each of the light emitting devices starts repetition of the lighting pattern using the arrangement order; and transmitting lighting information including the start time to each of the light emitting devices and causes each of the light emitting devices to start the repetition of the lighting pattern.

* * * * *